US005505109A

United States Patent [19]

Okonski et al.

[11] Patent Number: 5,505,109

[45] Date of Patent: Apr. 9, 1996

[54] CUTTING DIE AND CHISEL

[75] Inventors: Frank Okonski, Harwood Heights; Edward J. Porento, Sr., Des Plaines, both of Ill.

[73] Assignee: Best Cutting Die Company, Skokie, Ill.

[21] Appl. No.: 233,519

[22] Filed: Apr. 26, 1994

[51] Int. Cl.[6] ..... B26D 7/26

[52] U.S. Cl. ..... 83/622; 83/698.21

[58] Field of Search ..... 83/60, 52, 620, 83/622, 698.21; 30/167, 167.1, 168

[56] References Cited

U.S. PATENT DOCUMENTS

| | | |
|---|---|---|
| 1,746,048 | 2/1930 | Novick . |
| 1,766,244 | 6/1930 | Cumfer . |
| 1,927,728 | 9/1933 | Wolff . |
| 2,055,295 | 9/1936 | Kessler . |
| 2,791,276 | 5/1957 | Weller . |
| 2,837,025 | 6/1958 | Pechy . |
| 2,898,854 | 8/1959 | Crawford . |
| 3,128,681 | 4/1964 | Miller . |
| 3,172,321 | 3/1965 | Schrader . |
| 3,209,630 | 10/1965 | McCartan . |
| 3,270,602 | 9/1966 | Kirby et al. . |
| 3,522,754 | 8/1970 | Sauer . |
| 3,530,794 | 9/1970 | Ritzerfeld . |
| 3,533,355 | 10/1970 | Wall . |
| 3,618,438 | 11/1971 | Simson . |
| 3,670,646 | 6/1972 | Welch, Jr. . |
| 3,730,092 | 5/1973 | Pickard et al. . |
| 3,744,384 | 7/1973 | Jarritt et al. . |
| 3,752,042 | 8/1973 | Castille . |
| 3,789,715 | 2/1974 | Schuchardt et al. . |
| 3,797,351 | 3/1974 | Jones, Jr. . |
| 3,810,055 | 5/1974 | Wright . |
| 3,824,927 | 7/1974 | Pugh et al. . |
| 3,965,786 | 6/1976 | D'Luhy . |
| 3,975,976 | 8/1976 | Prentice . |
| 4,004,479 | 1/1977 | Bodnar . |
| 4,020,724 | 5/1977 | Quinlan . |
| 4,233,873 | 11/1980 | Jessen . |
| 4,237,786 | 12/1980 | Sanford . |
| 4,289,492 | 9/1981 | Simpson . |
| 4,450,740 | 5/1984 | Chapman, Jr. et al. . |
| 4,537,588 | 8/1985 | Ehlscheid et al. . |
| 4,645,484 | 2/1987 | Niske . |
| 4,726,804 | 2/1988 | Stitcher . |
| 4,742,769 | 5/1988 | Zeller . |
| 4,809,609 | 3/1989 | Sugiura et al. . |
| 4,823,659 | 4/1989 | Falasconi . |
| 4,878,407 | 11/1989 | Harrison et al. . |
| 4,982,639 | 1/1991 | Kirkpatrick . |
| 5,074,180 | 12/1991 | Mayer et al. . |
| 5,095,830 | 3/1992 | Love . |
| 5,109,741 | 5/1992 | Fuchs . |
| 5,119,707 | 6/1992 | Fischer . |
| 5,186,108 | 2/1993 | Hillebrand . |

FOREIGN PATENT DOCUMENTS

| | | |
|---|---|---|
| 0312422B1 | 4/1992 | European Pat. Off. . |
| 0519661A1 | 12/1992 | European Pat. Off. . |
| 2133734 | 8/1984 | United Kingdom . |

*Primary Examiner*—Hwei-Siu Payer
*Attorney, Agent, or Firm*—Sitrick & Sitrick

[57] ABSTRACT

A cutting die and chisel for cutting a stack of material such as paper and the like. The cutting die has a cutting edge for cutting a central portion in the material and the chisel has a cutting edge for cutting the excess peripheral portion of the stack so that the peripheral portion does not interfere with the cutting of the central portion. The chisel has a body portion for receiving at least one magnet so that the chisel may be magnetically attached to the periphery of the chisel.

14 Claims, 4 Drawing Sheets

CUTTING DIE AND CHISEL

FIELD OF THE INVENTION

The present invention relates generally to cutting dies for cutting stacks of paper and the like and, more particularly, to a cutting die having a chisel for cutting the stack.

BACKGROUND OF THE INVENTION

A cutting die having a chisel attached to its outer periphery is typically utilized to accurately cut stacks of paper material and the like. The cutting die has a raised cutting edge which is adapted to engage and cut the desired shape in a central portion of the stack of paper. The chisel has a cutting edge which is adapted to engage and cut the peripheral portions of the paper which form the excess and scrap portions of the paper. By cutting the peripheral portions of the stack, the peripheral portions of the paper do not bind and cause the inaccurate cuts in the central portion.

The chisel is typically attached to the cutting die using screws and the like. Unfortunately, manufacturing corresponding screw holes in the cutting die and chisel is relatively expensive and time consuming. Similarly, constantly assembling and disassembling the cutting die/chisel combination for different cutting operations is relatively difficult and time consuming. Furthermore, the chisel cannot be repositioned about the periphery of the cutting die since the chisel is screwed to the cutting die. Attempts to magnetically attach the chisel to the cutting die heretofore have been relatively unsuccessful because the magnets have not been strong enough to resist the forces exerted upon the chisel during the cutting operation and the chisel moved relative to the cutting die.

OBJECTS AND SUMMARY OF THE INVENTION

It is an object of the present invention to provide an improved chisel which can be easily and quickly attached to the periphery of the cutting die.

It is a similar object of the present invention to provide a chisel which can be attached to the periphery of the cutting die.

It is another object of the present invention to provide a cutting die and chisel which can be easily and quickly assembled and disassembled.

A cutting apparatus comprising a cutting die and chisel is provided for cutting a stack of material such as paper and the like. The cutting die has a cutting edge for cutting a central portion in the material and the chisel has a cutting edge for cutting the excess peripheral portion of the stack so that the peripheral portion does not interfere with the cutting of the central portion. The chisel has a body portion for receiving at least one magnet so that the chisel may be magnetically attached to the periphery of the chisel.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
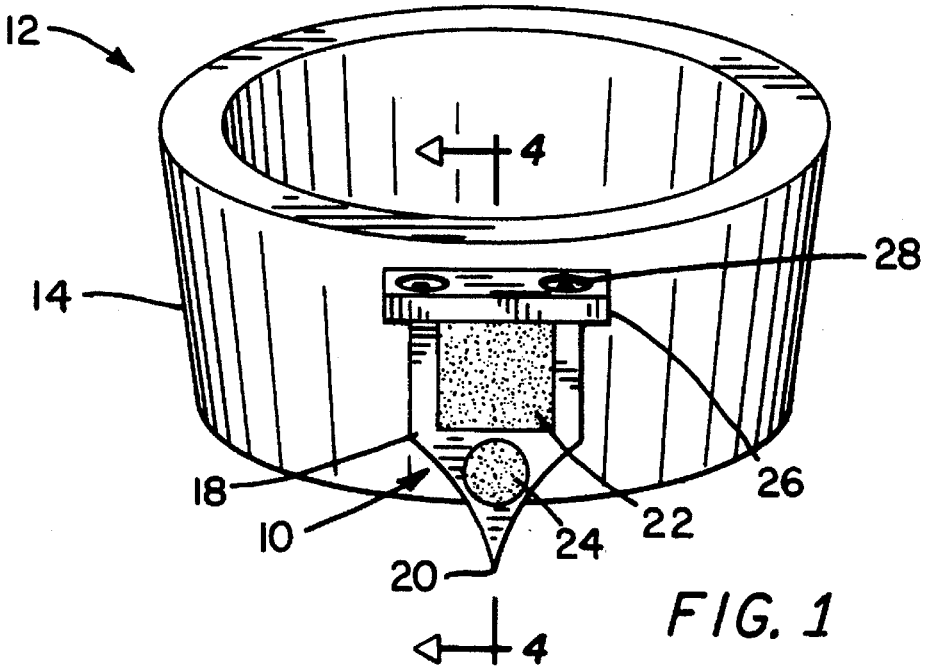
FIG. 1 is a perspective view of a cutting die and a chisel in accordance with one embodiment of the present invention.
Figure 2:
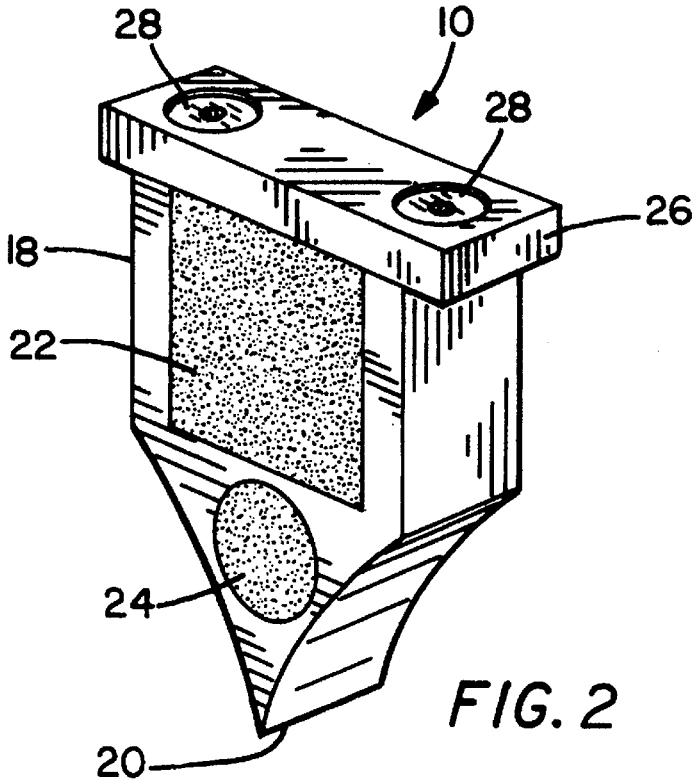
FIG. 2 is a perspective view of the chisel shown in FIG. 1.
Figure 3:
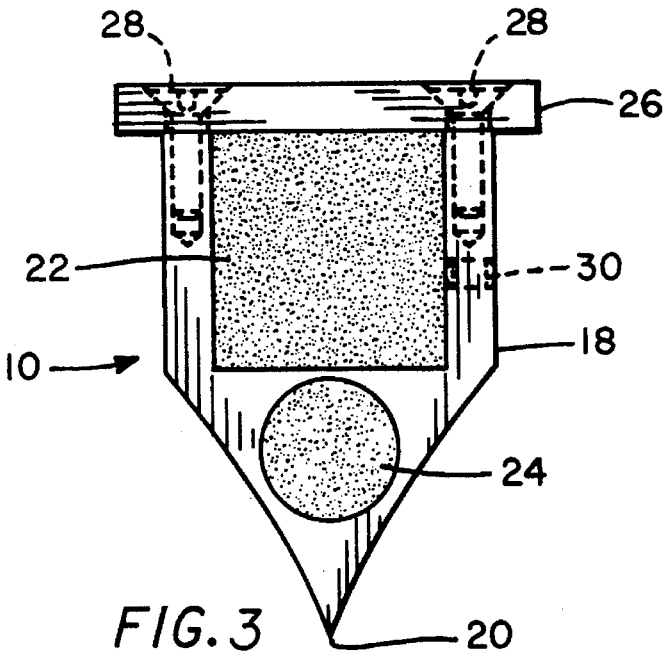
FIG. 3 is an elevational view of the chisel shown in FIG. 1.
Figure 5:
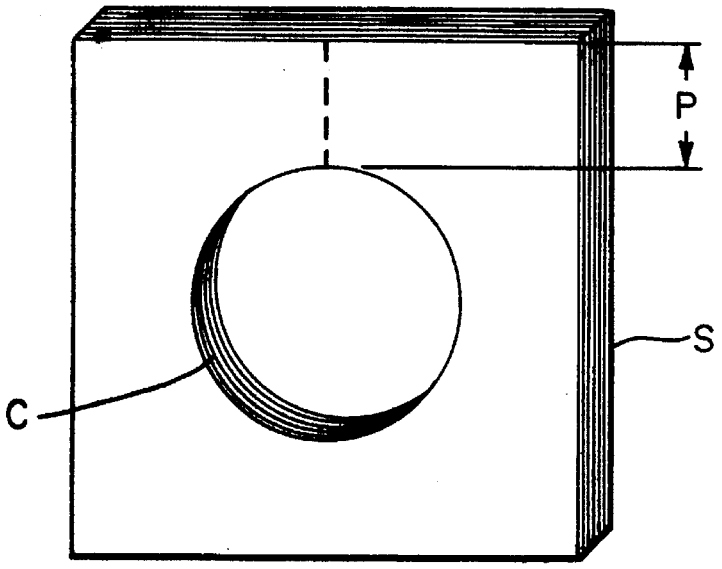
FIG. 5 is a plan view of the stack of material illustrating the central portion of the stack which is cut by the cutting die and the peripheral portion which is cut by the chisel.

Referring to the drawings and more particularly to FIG. 1, one embodiment of a chisel 10 is attached to a cutting die 12 in accordance the present invention. The cutting die 12 has a body portion 14 and a cutting edge 16 which is utilized to cut any desired shape in a stack of material such as paper or the like. In the illustrated embodiment, the cutting die 12 and the cutting edge 16 have generally circular cross sections but it will be appreciated that they may have any desired and suitable cross section. As illustrated in FIG. 5, when the cutting edge 16 engages the stack of paper S, it cuts a central portion C in the stack S, while leaving excess scrap portion P about the periphery of central portion C. The cutting die 12 may be manufactured of any suitable material but it has been found that stainless steel is particularly appropriate.

The chisel 10 has a body portion 18 and a cutting edge 20 so that when the chisel 10 is attached to the cutting die 12, the cutting edge 20 engages and cuts the excess peripheral portions P of the stack S. The chisel 10 insures that the peripheral portions P do not bind and interfere with the cutting operation of the cutting die 12. Although in the illustrated embodiment, the body portion 18 has a rectangular cross section which narrows to the cutting edge 20, it will be appreciated that the body portion 18 may have any shape and size which is capable of attaching to the cutting die 12 and cutting the excess peripheral portions P in the stack S.

In accordance with certain objects of the invention, the chisel 10 has at least one magnet 22 disposed in the body portion 18 which permits the chisel 10 to be magnetically attached to the cutting die 12. The magnet 22 must have sufficient attractive strength to permit the chisel 10 to be attached to the cutting die 12 and to withstand the forces which are exerted on the chisel 10 during the cutting operation so that the chisel 10 is held in a stationary position relative to the cutting die 12. It has been found that magnets of the type which are manufactured as Neodymium Rare Earth magnets by Bunting Magnetics Company in Newton, Kans. are satisfactory.

In order to maximize the attractive forces between the chisel 10 and the cutting die 12, it is desirable that the size of the magnet 22 in the body portion 18 be maximized. In the illustrated embodiment, rectangular 22 and circular magnets 24 are disposed in the body portion 18 of the chisel 10. The chisel 10 has an end piece 26 which can be attached to the body portion 18 using screws 28 or the like to ease assembly and insertion of the rectangular magnet 22 into the body portion 18 of the chisel 10. In order to hold the magnet 22 in the body portion 10, it may be necessary to have a set screw 30 or the like. It has been found that manufacturing the body portion of the chisel 10 from stainless steel has been satisfactory, but any other suitable material may used which will be known to those skilled in the art. The end piece 26 may also be manufactured from materials such as stainless steel or even magnetized material to provide additional magnetic attraction with the cutting die 12.

Figure 4:
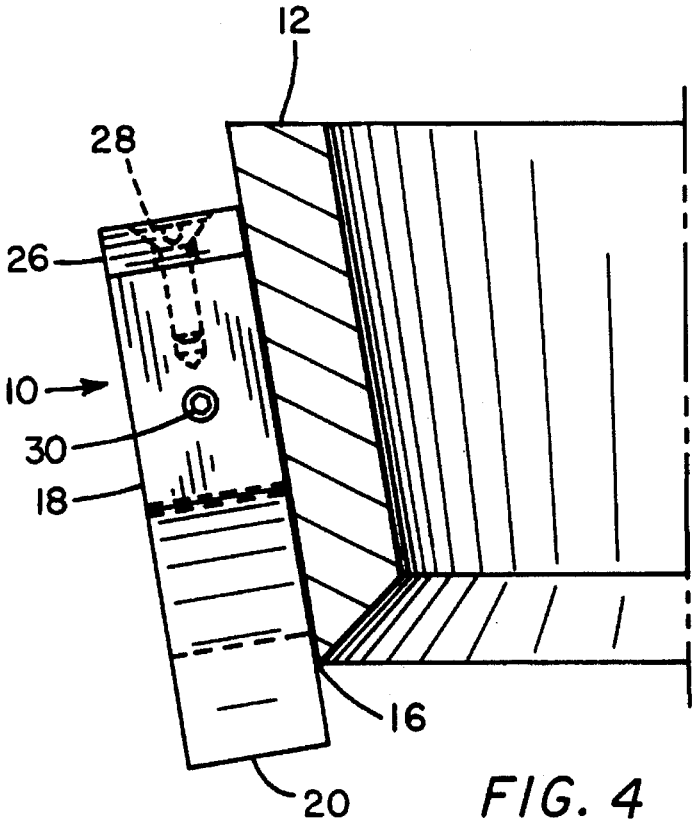
FIG. 4 is a sectional view taken along line 4—4 shown in FIG. 1.

In order to operate the cutting die 12 and the chisel 10, the chisel 10 is attached to the cutting die 12 by disposing the chisel 10 adjacent to the outer periphery of the cutting die 12 so that the magnets 22, 24 magnetically attach the chisel 10 and the cutting die 12 together as best shown in FIGS. 1 and 4. The cutting die/chisel combination is then attached to a conventional press system which actuates the combination and cuts the stack S. It will thus be appreciated that the chisel 10 may be quickly and easily assembled to or disassembled from the cutting die 12. It will also be appreciated that any number of chisels 10 may be quickly and easily attached to the periphery of the cutting die 12 as needed in the particular cutting operation.

The cutting die 12 and the chisel 10 are disposed so that the cutting edge 20 of the chisel 10 projects outwardly from the cutting edge 16 of the cutting die 12 as generally shown in FIG. 4. The chisel 10 is thus positioned to cut the peripheral portions P of the stack S before the cutting die 12 cuts the central portion C, thereby preventing the excess peripheral portions P from interfering with the cutting operation.

Figure 6:
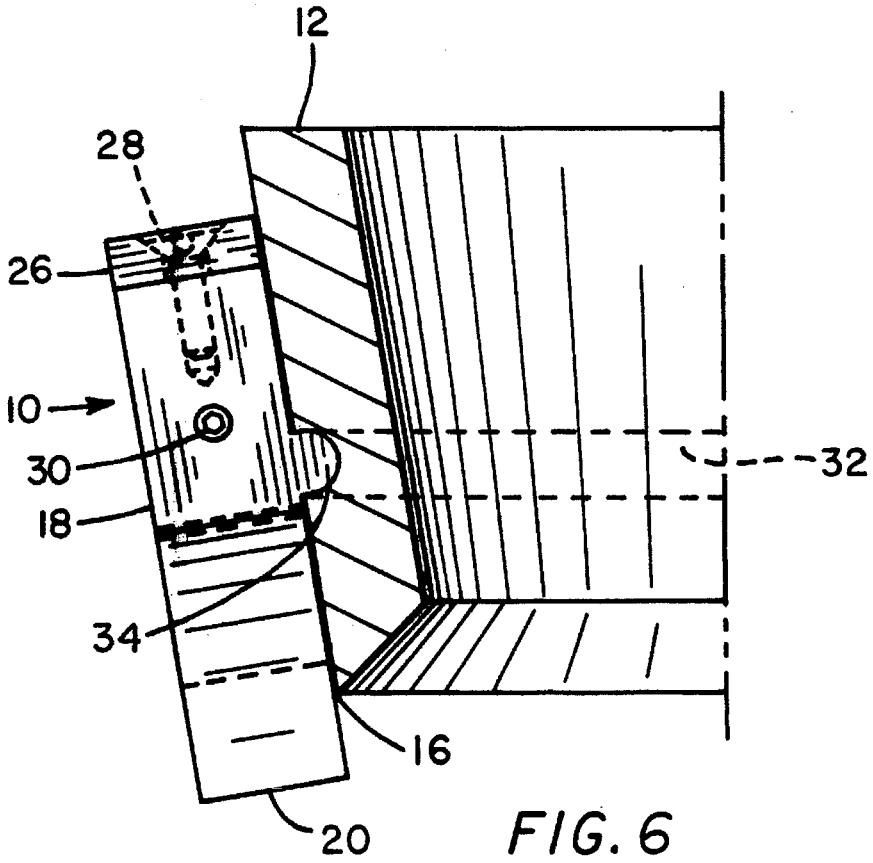
FIG. 6 is a cross-sectional view taken along line 6—6 in FIG. 7.
Figure 7:
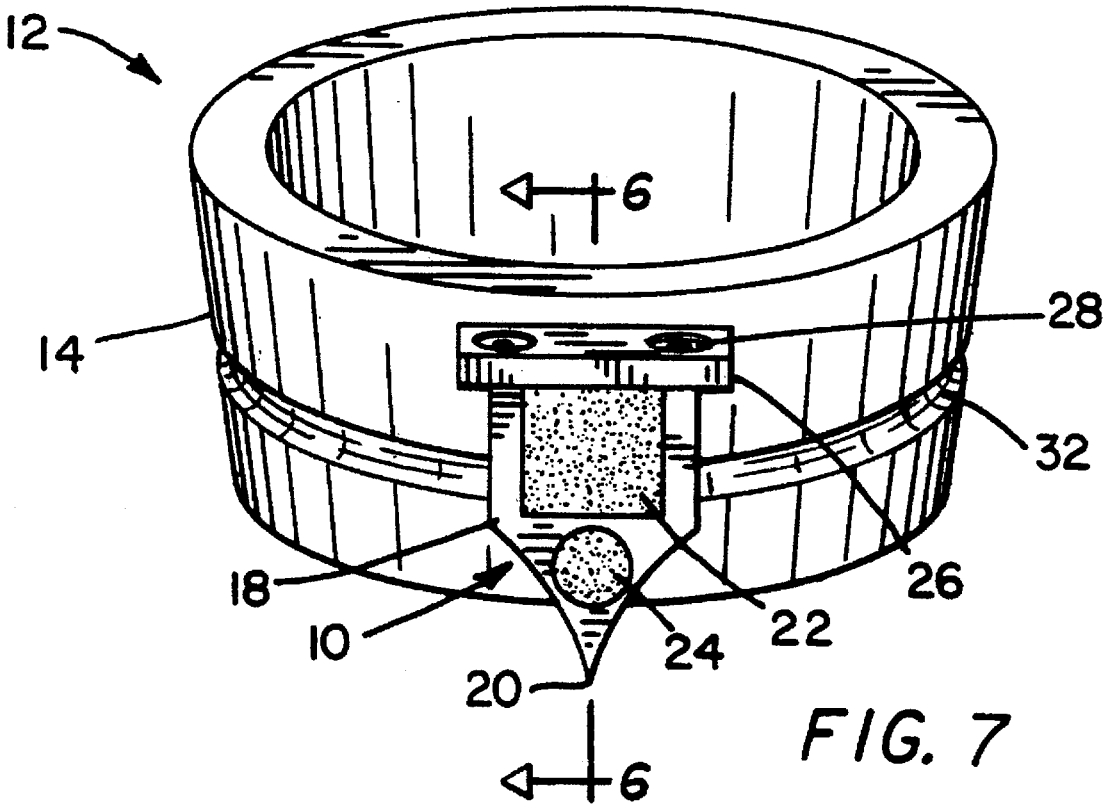
FIG. 7 is a perspective view of a cutting die and a chisel in accordance with one embodiment of the present invention.

In another embodiment illustrated in FIGS. 6–7, the cutting die 12 has a groove 32 disposed around the periphery of the body portion 14. The chisel 10 has a protrusion 34, such as a weld bead, which is adapted to engage and cooperate with the groove 32 to align the chisel 10 in a predetermined position relative to the cutting die 12. Thus, any number of chisels 10 may be quickly and reliably attached to the cutting die 12 such that the chisel cutting edge 20 projects outwardly from the die cutting edge 16 by a predetermined distance. The protrusion and the groove also cooperate to prevent the chisel 10 from sliding relative to the cutting die 12 during the cutting operation.

Thus, it will be seen that a cutting die and chisel apparatus have been provided which attain the aforenoted objects. Although the structure and operation of the apparatus has been described in connection with the cutting of paper-like material, it is not intended that the invention be limited only to such operations. Various additional modifications of the described embodiments of the invention specifically illustrated and described herein will be apparent to those skilled in the art, particularly in light of the teachings of this invention. The invention may be utilized in the cutting of any pattern from any relatively thin and flexible sheet-like material, including, for example, paper, cloth or plastic materials and labels, sanitary napkins, and the like. It is intended that the invention cover all modifications and embodiments which fall within the spirit and scope of the invention. Thus, while preferred embodiments of the present invention have been disclosed, it will be appreciated that it is not limited thereto but may be otherwise embodied within the scope of the following claims.

We claim as our invention:

1. A cutting assembly for cutting a central portion from a stack of material while leaving a peripheral portion, the cutting assembly comprising:

a cutting die having a cutting edge for engaging the stack and cutting the central portion therein, said cutting die comprised of a magnetically compatible material; and a chisel having a body portion, with at least one cavity, and a cutting edge for engaging the peripheral portion of the stack of material and generating a cutting force relatively perpendicular to the stack of material for cutting the stack, the body portion having at least one magnet located in the at least one cavity, for attaching the chisel to a surface of the cutting die wherein the surface of the cutting die is laterally disposed relative to the stack of material, the body portion also having an end piece mounted thereon for retaining the at least one magnet in the at least one cavity.

2. The cutting assembly as set forth in claim 1 wherein at least one chisel is disposed on the periphery of the cutting die.

3. The cutting assembly as set forth in claim 1 wherein the cutting edge of the chisel is disposed outwardly of the cutting edge of the cutting die so that the chisel cuts the peripheral portion of the stack before the cutting die cuts the central portion.

4. The cutting assembly as set forth in claim 1 comprising a plurality of screws for attaching the end piece to the body portion.

5. The cutting assembly as set forth in claim 1 wherein said at least one magnet comprises a rectangular magnet and a circular magnet.

6. The cutting assembly as set forth in claim 1 wherein the body portion has a rectangular cross section which narrows to the cutting edge.

7. The cutting assembly as set forth in claim 1 comprising a protrusion on one side of said chisel adapted to cooperatively engage a groove disposed in the cutting die to align the chisel in a predetermined position relative to the cutting die.

8. The cutting assembly as set forth in claim 1 comprising a protrusion on body portion adapted to cooperatively engage a groove disposed in the cutting die to align the chisel in a predetermined position relative to the cutting die.

9. A chisel for attaching to a cutting die which cuts a central portion from a stack of material while leaving a peripheral waste portion, the chisel comprising:

a body portion and a cutting edge for engaging the peripheral portion of the stack of material and generating a cutting force relatively perpendicular to the stack of material for cutting the stack, the body portion having at least one cavity and at least one magnet, located in the to least one cavity for attaching the chisel to a surface of the cutting die solely by magnetic attraction wherein the surface of the cutting die is laterally disposed relative to the stack of material; and an end piece coupled to a surface of the body portion for retaining the at least one magnet in the at least one cavity.

10. The chisel as set forth in claim 9 comprising a plurality of screws for attaching the end piece to the body portion.

11. The chisel as set forth in claim 9 wherein the body portion is further characterized as comprising a rectangular magnet and a circular magnet.

12. The chisel as set forth in claim 9 wherein the body portion has a rectangular cross section which narrows to the cutting edge.

13. The chisel as set forth in claim 9 comprising a protrusion on one side of said chisel adapted to cooperatively engage a groove disposed in the cutting die to align the chisel in a predetermined position relative to the cutting die.

14. The chisel as set forth in claim 9 comprising a protrusion on body portion adapted to cooperatively engage a groove disposed in the cutting die to align the chisel in a predetermined position relative to the cutting die.

* * * * *